US007716784B2

(12) United States Patent
Yang et al.

(10) Patent No.: US 7,716,784 B2
(45) Date of Patent: May 18, 2010

(54) SUCTION PORT ASSEMBLY AND VACUUM CLEANER HAVING THE SAME

(75) Inventors: Dong-houn Yang, Gwangju (KR); Hiroyuki Uratani, Gwangju (KR); Hwa-gyu Song, Gwangju (KR); Sung-cheol Lee, Seoul (KR); Hyun-ju Lee, Gwangju (KR)

(73) Assignee: Samsung Gwangju Electronics Co., Ltd, Gwangju (KR)

( * ) Notice: Subject to any disclaimer, the term of this patent is extended or adjusted under 35 U.S.C. 154(b) by 220 days.

(21) Appl. No.: 11/975,400

(22) Filed: Oct. 19, 2007

(65) Prior Publication Data

US 2008/0289138 A1 Nov. 27, 2008

(30) Foreign Application Priority Data

May 21, 2007 (KR) ..... 10-2007-0049338

(51) Int. Cl.
*A47L 5/10* (2006.01)

(52) U.S. Cl. ..... 15/383; 15/362; 15/386

(58) Field of Classification Search ..... 15/383, 15/362, 386

See application file for complete search history.

(56) References Cited

U.S. PATENT DOCUMENTS 5,557,822 A * 9/1996 Yagi et al. ..... 15/369

FOREIGN PATENT DOCUMENTS

| | | | |
|---|---|---|---|
| EP | 0563116 | * | 3/1997 |
| EP | 0563116 | | 9/2007 |
| KR | 1990-16639 | | 10/1990 |

* cited by examiner

*Primary Examiner*—Joseph J Hail, III
*Assistant Examiner*—Shantese McDonald
(74) *Attorney, Agent, or Firm*—Ohlandt, Greeley, Ruggiero & Perle, L.L.P.

(57) ABSTRACT

A suction port assembly and vacuum cleaner having the same is disclosed. The suction port assembly includes a casing comprising a suction port which draws in dust from a surface being cleaned; a drum brush which is disposed rotatably in the casing, on an external surface of which a plurality of bristles are arranged to shake off dust from the surface being cleaned; and a rib which is disposed at a position close to the drum brush, is mounted in the casing so that its one end is in contact with the bristles, and detaches the dust from the bristles when the drum brush rotates; and wherein the bristles are contacted on a slant relative to the rib to prevent the drum brush from rotating when the casing is pulled towards a user.

6 Claims, 7 Drawing Sheets

SUCTION PORT ASSEMBLY AND VACUUM CLEANER HAVING THE SAME

CROSS-REFERENCE TO RELATED APPLICATIONS

This application claims priority under 35 U.S.C. §119 from Korean Patent Application No. 10-2007-0049338, filed on May 21, 2007, in the Korean Intellectual Property Office, the disclosure of which is incorporated herein by reference in its entirety.

BACKGROUND OF THE INVENTION

1. Field of the Invention

The present disclosure relates to a suction port assembly and a vacuum cleaner having the same, and more particularly, to a suction port assembly constructed in order to reduce noise and improve the functioning of a brush sweeping dust off a surface being cleaned, and a vacuum cleaner having the same.

2. Description of the Related Art

A conventional vacuum cleaner sucks in dust containing dirt from a surface being cleaned using suction force generated by driving a driving source mounted in a cleaner main body.

The vacuum cleaner comprises a cleaner main body with a motor which generates suction force, a suction port assembly which draws in dust from the surface being cleaned, and an extension path which guides the in-drawn dust into the cleaner main body.

FIGS. 1 and 2 illustrate schematically an exemplary embodiment of a suction port assembly in the prior art. FIG. 1 is a plan view illustrating a suction port assembly in the prior art, and FIG. 2 is a cross sectional view illustrating the suction port assembly of FIG. 1.

Referring to FIG. 2, a suction port opened to the exterior 110 is formed at the front end of a suction port assembly 100. Dust is introduced from a surface being cleaned into the suction port assembly 100 through the suction port 110. The dust moves along a dust flow passage (S) through the extension path, and is subsequently piled up in a dust separating chamber in the cleaner main body.

The suction port 110 of the suction port assembly 100 comprises a cylindrical drum brush 120 which is disposed so as to be able to rotate. A plurality of bristles are disposed in a radial formation around the circumference of the drum brush 120, which is not illustrated in FIG. 2. When a user pushes and pulls the suction port assembly 100 over the surface being cleaned, the bristles of the drum brush 120 shake dust from the surface being cleaned. Accordingly, the sucking efficiency of the vacuum cleaner is improved.

If a vacuum cleaner having the drum brush 120 is used for a long period of time, dust may accumulate on the external surface of the drum brush 120. At this time, it is difficult for the bristles to detach dust from the surface being cleaned, and suction force may be reduced.

Korean Utility Model Laid Open No. 1990-16639 and European Patent No. 563116 disclose a technique to improve the problems designed above. These reports disclose components corresponding to the bristles on the external surface of the drum brush 120 described above, and members disposed in the suction port assembly to detach dust from the bristles.

The member to shake dust from the hair is referred to as a cleaner 5 in Korean Utility Model Laid Open No. 1990-16639, and as a comb-shaped plate 12 in Europe Patent No. 563116. The cleaner 5 and comb-shaped plate 12 are both mounted on a side wall of the suction port assembly, and both have a comb-like shape.

As illustrated in FIG. 2, some noise generated from the cleaner main body is transferred to the suction port assembly 100 through an extension pipe, and the noise travels through the suction port assembly 100 along noise path (N), and is emitted externally through the suction port 110. The suction port 110 may function simultaneously as a dust inlet, and an outlet through which noise is emitted externally. Noise reaches ears of a user such that the user feels noisy.

The cleaner 5 and comb-shaped plate 12 are formed in a comb shape, and a space is formed between the member and drum brush for air to passthrough. Accordingly, noise flowing back from a motor to the suction port reaches a user through the suction port despite reaching the "cleaner" 5 or "comb-shaped plate" 12.

Korean Utility Model Laid Open No. 1990-16639 discloses a "rotating brush" 3 corresponding to the drum brush 120, and European Patent No. 563116 discloses "brush roller" corresponding to the drum brush 120.

The rotating brush 3, and brush roller being in contact with a surface being cleaned are provided to rotate in two directions while a user cleans the surface being cleaned. That is, the rotating brush 3, or brush roller moves in contact with the surface being cleaned regardless of whether a user pushes or pulls the suction port assembly having the rotating brush 3, or brush roller. However, if the rotating brush 3, or brush roller corresponding to the drum brush only rolls across the surface, it is difficult to remove dust and hair sticking strongly to a surface being cleaned, such as hair entangled in a carpet.

SUMMARY OF THE INVENTION

Exemplary embodiments of the present disclosure address at least the above problems and/or disadvantages and other disadvantages not described above. Also, the present disclosure is not required to overcome the disadvantages described above, and an exemplary embodiment of the present disclosure may not overcome any of the problems described above.

The present disclosure provides a suction port assembly to reduce noise flowing backward from a cleaner main body to the suction port assembly, and to improve the function of bristles separating and sweeping dust from a surface being cleaned, and a vacuum cleaner having the same.

According to an exemplary aspect of the present disclosure, there is provided a suction port assembly comprising a casing comprising a suction port which draws in dust from a surface being cleaned; a drum brush which is disposed rotatably in the case, on an external surface of which a plurality of bristles are arranged to shake off dust from the surface being cleaned; and a rib which is disposed at a position close to the drum brush, is mounted in the casing so that its one end is in contact with the bristles, and detaches the dust from the bristles when the drum brush rotates; and wherein the bristles are contacted on a slant relative to the rib to prevent the drum brush from rotating when the casing is pulled towards a user.

The bristles may be arranged on the drum brush at an angle of inclination relative to the radial direction.

The rib may be disposed to fill a space between the casing and the drum brush in order that the noise flowing back from a cleaner main body to the rib is not emitted to the exterior of the suction port assembly.

The rib may be formed as a rectangular plate, and be arranged lengthwise parallel to the drum brush.

The suction port assembly may further comprise at least one rib supporting member which is disposed in the casing to support the rib.

According to another exemplary aspect of the present disclosure, there is provided a vacuum cleaner comprising: a cleaner main body which provides suction force; a suction port assembly which receives the suction force from the cleaner main body, and draws in air containing dirt from a surface being cleaned; and an extension path which guides the suction force from the cleaner main body into the cleaner suction port assembly, wherein the suction port assembly comprises, a casing comprising a suction port which draws in dust from a surface being cleaned; a drum brush which is disposed rotatably in the case, on an external surface of which a plurality of bristles are arranged to shake off dust from the surface being cleaned; and a rib which is disposed at a position close to the drum brush, is mounted in the casing so that its one end is in contact with the bristles, and detaches the dust from the bristles when the drum brush rotates, and wherein the bristles are contacted on a slant relative to the rib to prevent the drum brush from rotating when the casing is pulled towards a user.

The rib may be disposed to fill a space between the casing and the drum brush in order that the noise flowing back from a cleaner main body to the rib is not emitted to the exterior of the suction port assembly.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF EXEMPLARY EMBODIMENTS

Figure 1:
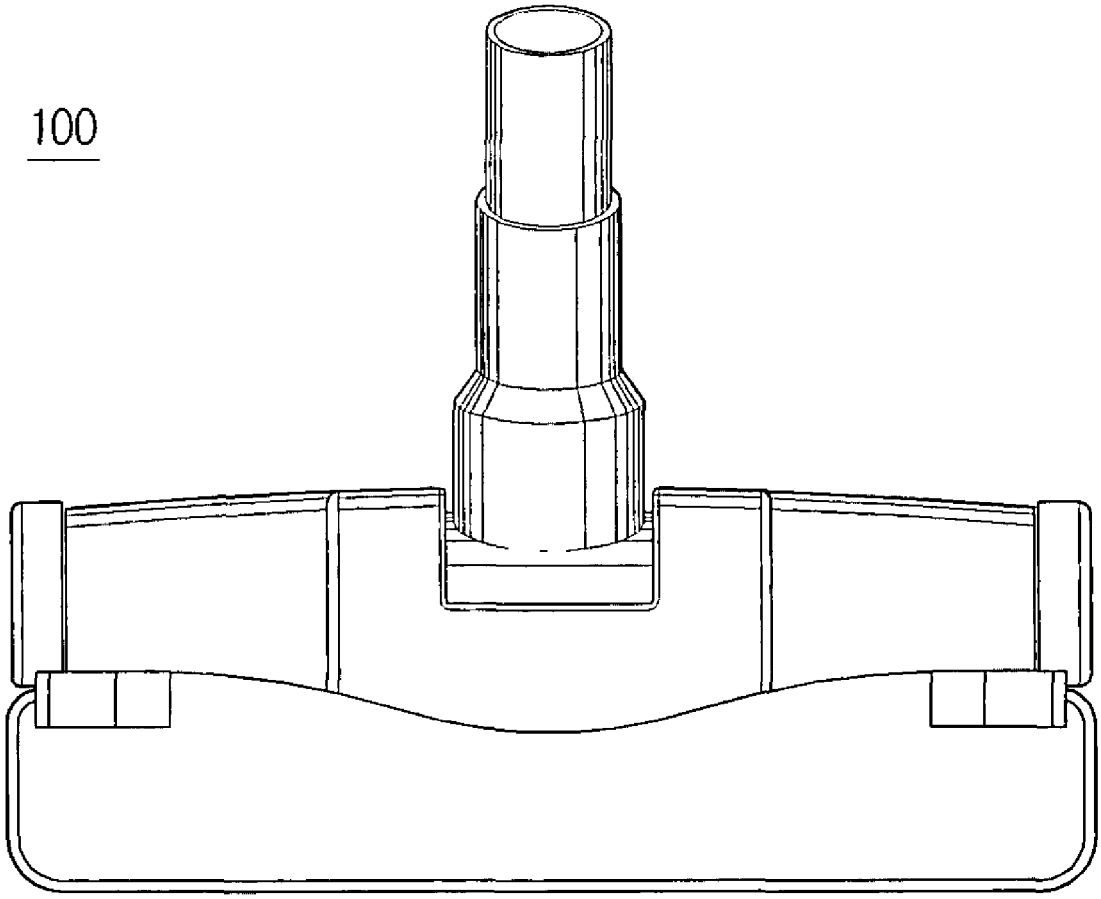
FIG. 1 (PRIOR ART)
FIG. 1 is a plan view illustrating a suction port assembly of the prior art.
Figure 2:
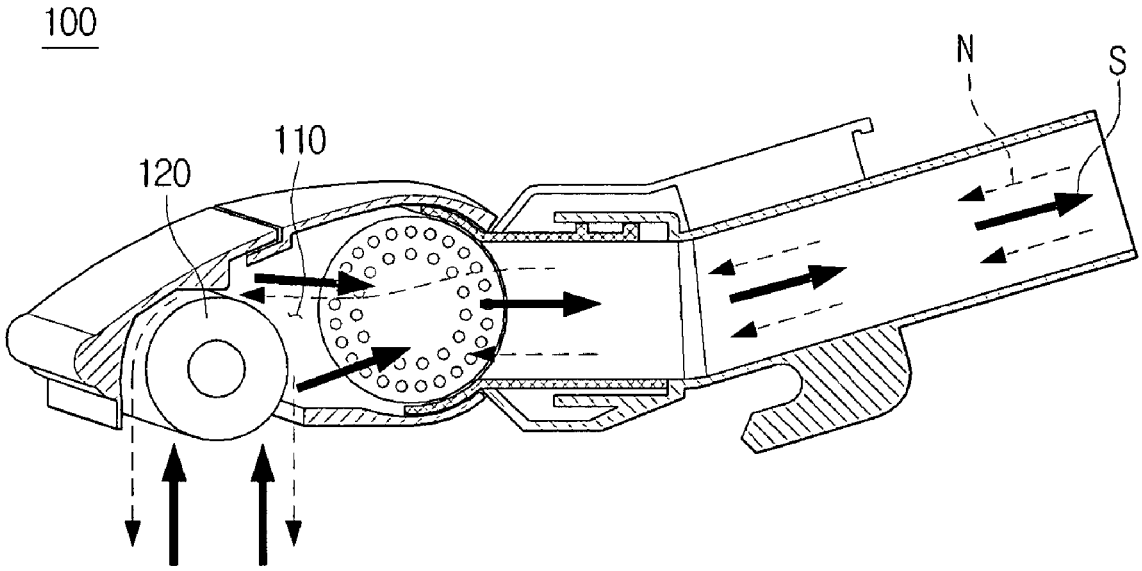
FIG. 2 (PRIOR ART)
FIG. 2 is a cross sectional view illustrating the suction port assembly of FIG. 1.

Certain exemplary embodiments of the present disclosure will now be described in greater detail with reference to the accompanying drawings.

In the following description, same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

Figure 3:
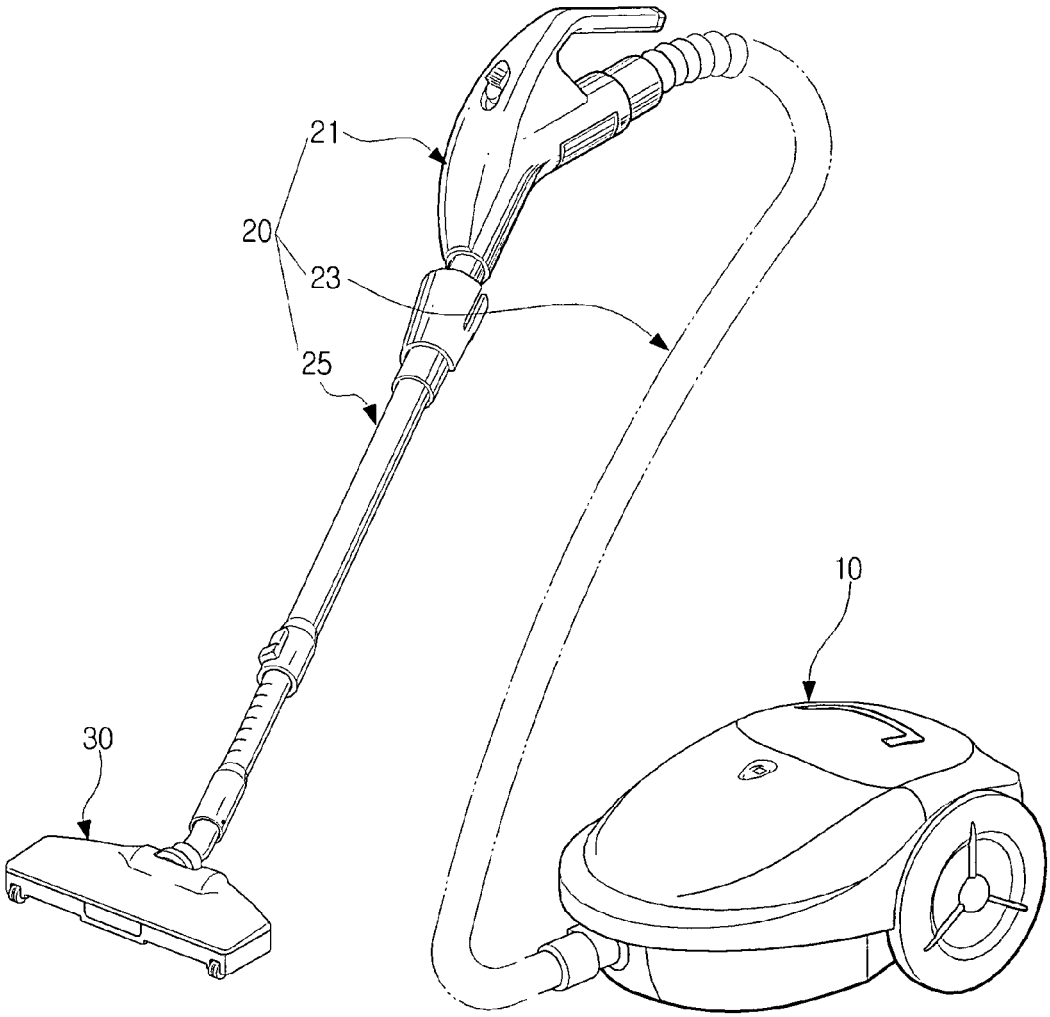
FIG. 3 is a schematic view illustrating a vacuum cleaner according to an exemplary embodiment of the present disclosure.
Figure 4:
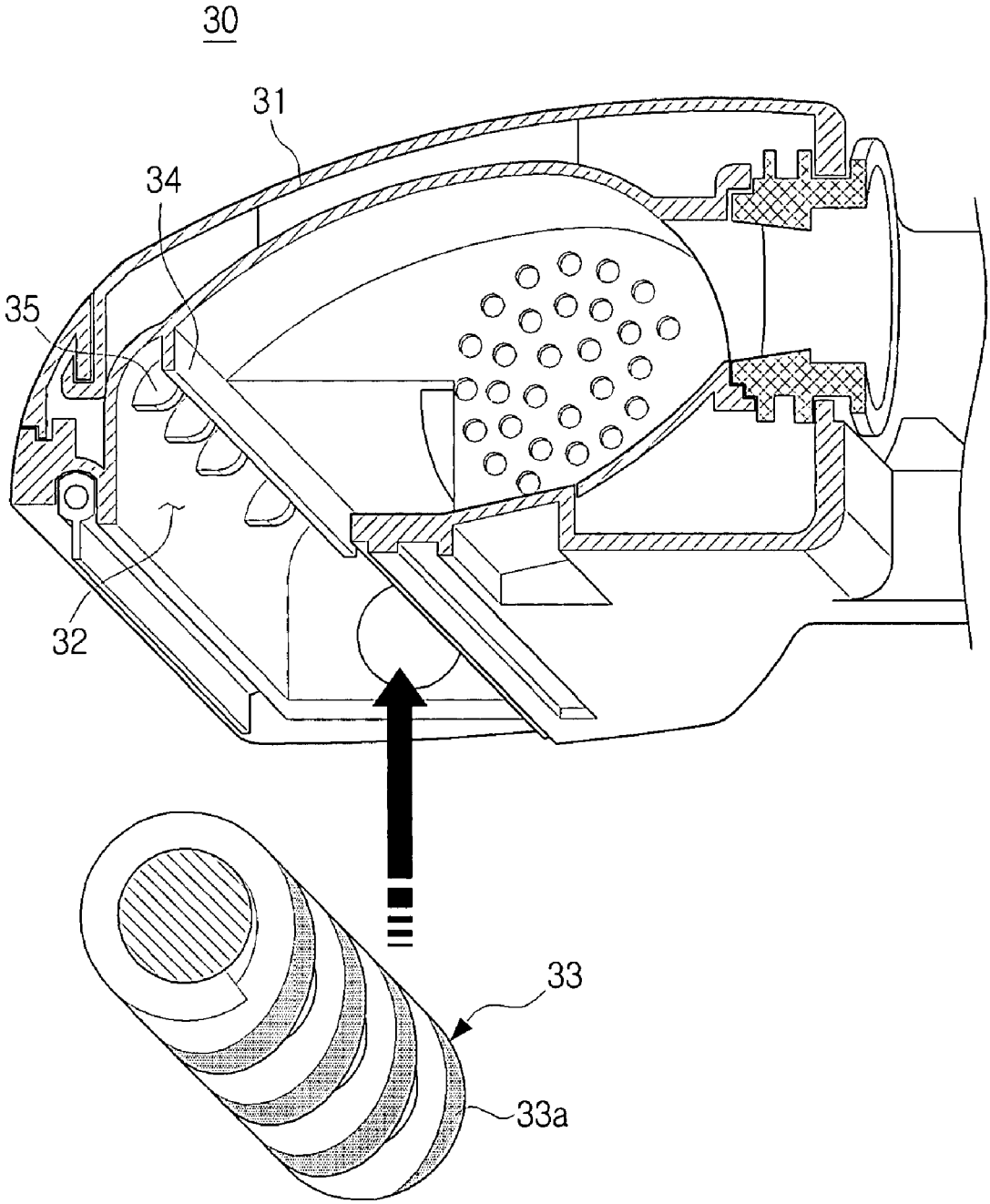
FIG. 4 is a fragmentary sectional view illustrating a suction port assembly of the vacuum cleaner of FIG. 3.
Figure 5:
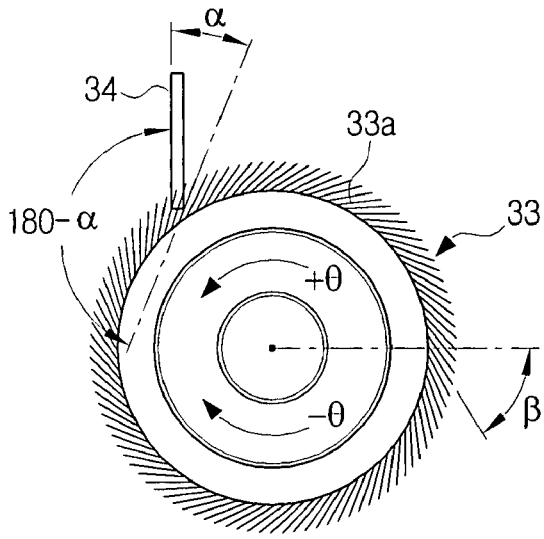
FIG. 5 is an enlarged side view illustrating a drum brush of FIG. 4.
Figure 6:
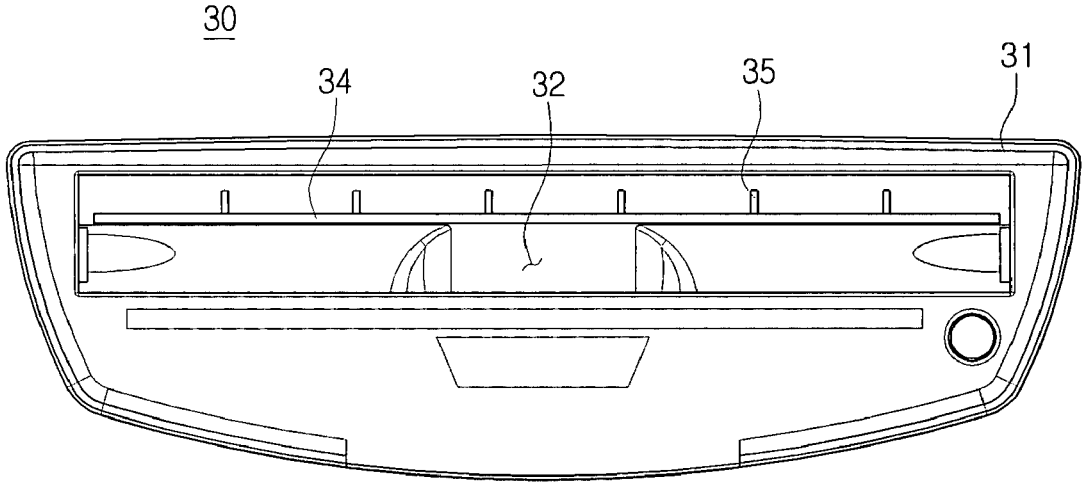
FIG. 6 is a bottom view illustrating the suction port assembly of FIG. 4.

FIG. 3 is a schematic view illustrating a vacuum cleaner according to an exemplary embodiment of the present disclosure, FIG. 4 is a fragmentary sectional view illustrating a suction port assembly of the vacuum cleaner of FIG. 3, FIG. 5 is an enlarged side view illustrating the drum brush of FIG. 4, and FIG. 6 is a bottom view illustrating the suction port assembly of FIG. 4.

Referring to FIG. 3, a vacuum cleaner according to an exemplary embodiment of the present disclosure may comprise a main cleaner body 10, an extension path 20, and a suction port assembly 30.

The main cleaner body 10 may comprise a motor (not illustrated) to generate suction force in order to suck in dust from a surface being cleaned, and a separating portion (not illustrated) to separate dust sucked in from the surface being cleaned.

The extension path 20 connects the main cleaner body 10 and the suction port assembly 30, and guides dust which the suction port assembly 30 sucks in to the main cleaner body 10. The extension path 20 comprises a handle 21 which is formed so that the user can grip the handle 21 to manipulate the suction port assembly 30, a flexible hose 23 which connects the handle 21 to the main cleaner body 10, and an extension pipe 25 which connects the handle 21 to the suction port assembly 30.

Referring to FIG. 4, the suction port assembly 30 forms an outward form of the suction port assembly 30, and comprises a casing 31 in which the various constituent parts are disposed.

A suction port 32 which opens externally is disposed below the casing 31. If the motor in the main cleaner body 10 is in operation, suction force is generated, and the suction force is transferred to the suction port 32 of the suction port assembly 30. If the suction port 32 is in contact with a surface being cleaned, dust on the surface being cleaned is sucked into the suction port 32 by the suction force transferred to the suction port 32.

Some dust firmly sticks to a surface being cleaned such that it may not be detached from the surface being cleaned by suction force. A more powerful suction force can be generated and provided to the surface being cleaned by substituting a motor in the main cleaner body 10 with a motor having a high driving power. Accordingly, the dust sticking to the surface being cleaned may be sucked in, but power consumption increases, and noise is generated and produced by the motor.

A drum brush 33 is provided in the suction port assembly 30 to detach the dust from the surface being cleaned while maintaining a sufficient proper suction force as illustrated in FIG. 4.

The drum brush 33 is disposed in the casing 31 of the suction port assembly 30 to occupy space in the suction port 32. The drum brush 33 has a substantially cylindrical shape, and a plurality of bristles 33*a* are arranged closely on the external surface of the drum brush 33 as illustrated in FIGS. 4 and 5. If a user pushes and pulls the suction port assembly 30 when cleaning a surface, the drum brush 33 may rotate while remaining in contact with the surface being cleaned. The plurality of bristles 33*a* arranged on the external surface of the drum brush 33 detach dust from the surface being cleaned. Accordingly, using the drum brush 33 is more effective than using only the suction force.

If the drum brush 33 is used for a long period of time, dust may stick to the bristles 33*a* on the external surface of the drum brush 33. In this case, it is difficult for the bristles 33*a* to perform their function of detaching dust from the surface being cleaned such that the suction force is reduced.

In FIGS. 4 to 6, a rib 34 is disposed on the internal wall of the casing 31 of the suction port assembly 30 to remove dust from the bristles 33*a* while the drum brush 33 rotates. The rib 34 is disposed at a position close to the drum brush 33 so that its lower end is in contact with the bristles 33*a* on the external surface of the drum brush 33. Accordingly, if a user moves the suction port assembly 30 along the surface being cleaned, the rib 34 may remove dust from the bristles 33*a* on the drum brush 33 while the drum brush is rotating.

The rib 34 is formed as a rectangular plate, and is disposed lengthwise along the drum brush 33 in a row as illustrated in FIGS. 4 to 6. The rib 34 may take a form other than the rectangular plate, and there is no limit to the number of ribs, provided they detach dust.

If the rib 34 has a rectangular plate form, and occupies the space between the internal wall of the casing 31 and the drum brush 33, noise flowing back from the main cleaner body 10 to the suction port 32 may be prevented from leaving the suction port assembly 30. The space between the internal wall of the casing 31 and the drum brush 33 is occupied by the rib 34, so that the rib 34 detaches dust from the bristles 33*a* of the drum brush 33, and noise emitted from the vacuum cleaner is also reduced.

Referring to FIG. 5, the bristles 33*a* contact the rib 34 at an angle of inclination $\alpha$ to each other. As the bristles 33*a* are on a slant relative to the rib 34, the drum brush 33 may rotate in one direction, but not in the opposite direction when a user pushes or pulls the suction port assembly 30. If there is a predetermined angel of inclination a between the bristles 33*a* and the rib 34 as in the exemplary embodiment of the present disclosure, the drum brush 33 rotates only when a user pushes the suction port assembly 30, and is prevented from rotating when the user pulls the suction port assembly 30.

Specifically, if the rib 34 and the bristles 33*a* are arranged parallel to each other and not at the angle of inclination $\alpha$, the drum brush 33 may rotate freely in both directions, because, although the bristles 33*a* are in contact with the rib 34 when the drum brush 33 rotates, the bristles 33*a* and the rib 34 do not interfere with each other. When the bristles 33*a* do not interfere with the rib 34, the bristles 33*a* pass through a space between the lower end of the rib 34 and the external surface of the drum brush 33. On the other hand, when the bristles 33*a* interfere with the rib 34, the bristles 33*a* do not pass through a space between the lower end of the rib 34 and the external surface of the drum brush 33.

On the other hand, if the angle of inclination $\alpha$ is formed between the bristles 33*a* and the rib 34 as in the exemplary embodiment of the present disclosure, the drum brush 33 rotates when a user pushes the suction port assembly 30, but the drum brush 33 is prevented from rotating when the user pulls the suction port assembly 30.

When the user pushes the suction port assembly 30, rotational force is provided to the drum brush 33 in direction $+\theta$ as illustrated in FIG. 5. At this time, the bristles 33*a* with an acute angle of inclination $\alpha$ to the rib 34 enter pass between the lower end of the rib 34 and the drum brush 33 without interfering with the rib 34. Accordingly, rotation of the drum brush 33 is possible.

On the other hand, when a user pulls the suction port assembly 30, a rotational force is driven to the drum brush 33 in direction $-\theta$ as illustrated in FIG. 5. At this time, the bristles 33*a* with an obtuse angle of inclination 180-$\alpha$ enter the rib 34 so as to receive friction power from the rib 34, and interfere with the rib 34. That is, the bristles 33*a* are not capable of passing between the lower end of the rib 34 and the drum brush 33. Accordingly, the drum brush 33 is prevented from rotating.

The bristles 33*a* are arranged on the external surface of the drum brush 33 at an angle $\beta$ (referring to FIG. 5) relative to the radial direction such that an angle of inclination between the rib 34 and the bristles 33*a* is formed.

The drum brush 33 rotates only when a user pushes the suction port assembly 30. If a user pulls the suction port assembly 30 which is in contact with a surface being cleaned, the rib 34 prevents the drum brush 33 from rotating such that the bristles 33*a* provided on the drum brush 33 detach and sweep dust effectively from the surface being cleaned. On the other hand, if a user pushes the suction port assembly 30 which is in contact with the surface being cleaned, the rib 34 does not prevent the drum brush 33 from rotating such that the rib 34 detaches dust sticking to the bristles 33*a* of the brush 33.

Referring to FIGS. 4 to 6, a rib supporting member 35 engaged with a side surface of the rib 34 is mounted on the internal wall of the casing 31.

An operation of a vacuum cleaner having the above structure according to an exemplary embodiment of the present disclosure will be explained with reference to FIGS. 7 and 8.

Figure 7:
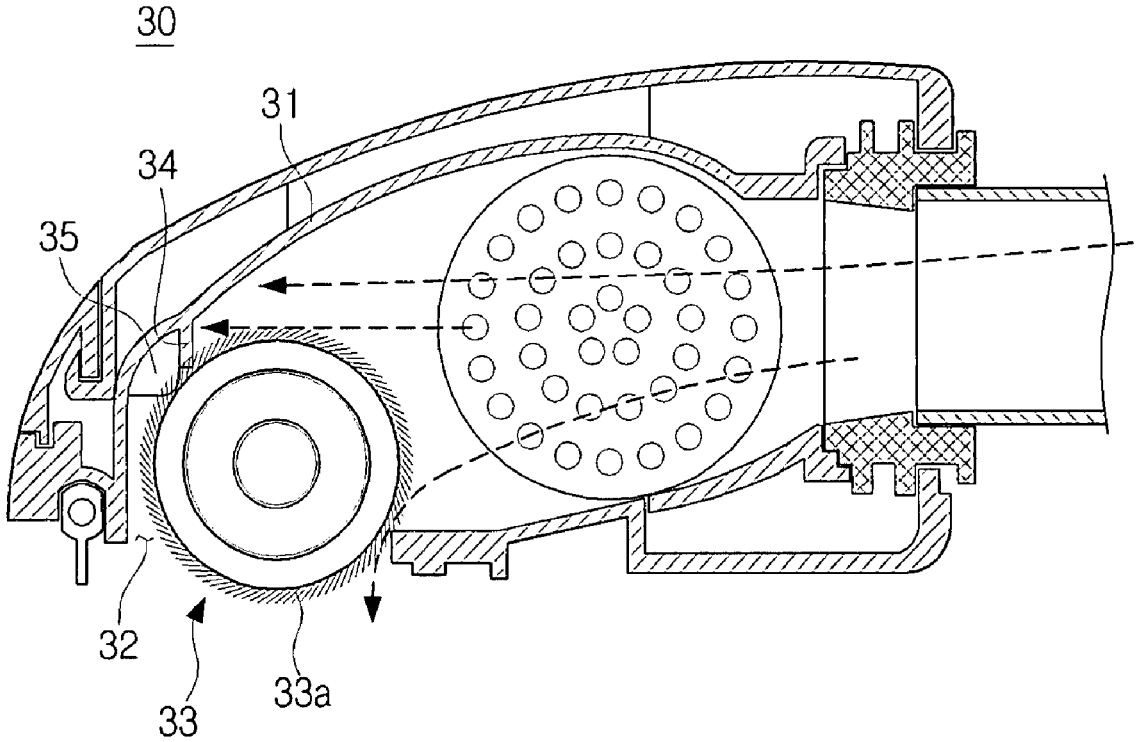
FIG. 7 is a sectional view explaining the noise absorbing structure of a suction port assembly according to an exemplary embodiment of the present disclosure.
Figure 8A:
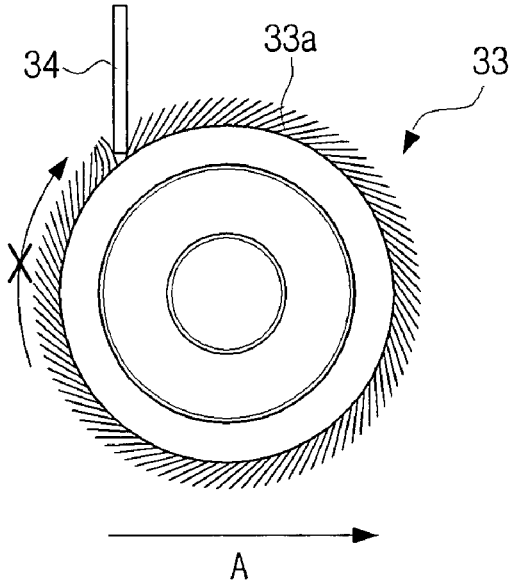
FIG. 8A is a schematic view explaining the rotation prevention of a drum brush according to an exemplary embodiment of the present disclosure.
Figure 8B:
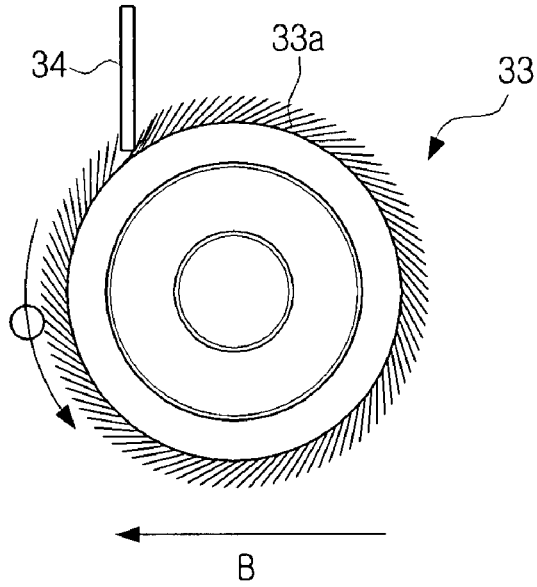
FIG. 8B is a schematic view explaining the rotation of a drum brush according to an exemplary embodiment of the present disclosure.

FIG. 7 is a sectional view explaining the noise absorbing structure of a suction port assembly according to an exemplary embodiment of the present disclosure, FIG. 8A is a schematic view explaining rotation prevention in a drum brush according to an exemplary embodiment of the present disclosure, and FIG. 8B is a schematic view explaining the rotation of a drum brush according to an exemplary embodiment of the present disclosure.

A user supplies power to the main cleaner body 10 to drive the motor in the main cleaner body 10 by manipulating an on/off button, and thereby cleans a surface being cleaned using a vacuum cleaner. The main cleaner body 10 causes the motor housed therein to generate suction force, and the suction force is transferred to the suction port assembly 30 through the extension path 20.

Noise is generated by the operation of the motor, and the noise travels back to the suction port assembly 30 via a passage through which suction force is transferred. The noise flowing back to the suction port assembly 30 moves to the suction port 32 as illustrated in FIG. 7. The noise traveling towards the rib 34 is absorbed by the bristles 33*a* instead of being emitted externally after colliding with the rib 34, because the rib 34 on the plate occupies the space between the internal wall of the casing 31 and the drum brush 33. Accordingly, noise emitted from the cleaner main body 10 may be reduced.

A user cleans a surface being cleaned by pushing or pulling the suction port assembly 30 along the surface being cleaned while the motor is operated. If the suction port assembly 30 is pulled towards a user, for example, in a first direction A to rotate in a direction X, the bristles 33*a* interfere with the lower end of the rib 34 because of the slope between the bristles 33*a* and the rib 34, as illustrated in FIG. 8A. Therefore, the drum brush 33 prevents the rib 34 from rotating. At this time, the bristles 33*a* on the drum brush 33 which are in contact with the surface being cleaned detach, and sweep dust effectively from the surface being cleaned by sliding along the surface being cleaned. As a result, suction force of the vacuum cleaner is improved.

If the suction port assembly is pushed away from a user, for example, in a second direction B to rotate in a direction O, as described in FIG. 8B, the bristles 33*a* arranged on the external surface of the drum brush 33 do not interfere with the rib 34 despite being in contact with the lower end of the rib 34. Accordingly, the drum brush 33 rotates continuously in contact with the surface being cleaned. The bristles 33*a* arranged on the external surface of the drum brush 33 collide and repeatedly pass by the lower end of the rib 34 such that dust is detached from the bristles 33*a* due to colliding with the rib 34. Therefore, the bristles 33*a* may remain free of dust although a user removes dust from the bristles 33*a* of the drum brush 33 by hand.

As described above, a rib is disposed on the internal wall of a casing in a suction port assembly, so noise which travels back from a vacuum cleaner to the suction port assembly and then to a user is reduced.

As a rib is on a slant relative to the bristles of a drum brush, the drum brush does not rotate when a user pulls a suction port assembly. Accordingly, the function of the bristles which detach, and sweep dust from a surface being cleaned can be improved.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A suction port assembly comprising:

a casing comprising a suction port which draws in dust from a surface being cleaned;

a drum brush which is disposed rotatably in the casing, the drum brush having a plurality of bristles on an external surface arranged to shake off dust from the surface being cleaned; and a rib which is disposed at a position close to the drum brush and is mounted in the casing so that one end is in contact with the plurality of bristles, and the rib being configured to detach the dust from the plurality of bristles when the drum brush rotates, wherein the plurality of bristles are arranged on the drum brush at an angle of inclination relative to a radial direction, and the bristles enter the rib with an obtuse angle so as to receive friction power from the rib, and the friction power prevents the drum brush from rotating when the suction port assembly is pulled towards a user.

2. The suction port assembly of claim 1, wherein the rib is disposed to fill a space between the casing and the drum brush in order that noise flowing back from a cleaner main body to the rib is not emitted to an exterior of the suction port assembly.

3. The suction port assembly of claim 2, wherein the rib is formed as a rectangular plate, and wherein the rib is arranged lengthwise parallel to the drum brush.

4. The suction port assembly of claim 3, further comprising at least one rib supporting member which is disposed in the casing to support the rib.

5. A vacuum cleaner comprising:

a cleaner main body which provides a suction force;

a suction port assembly which receives the suction force from the cleaner main body, and draws in air containing dirt from a surface being cleaned; and an extension path which guides the suction force from the cleaner main body into the suction port assembly, wherein the suction port assembly comprises, a casing comprising a suction port which draws in dust from a surface being cleaned;

a drum brush which is disposed rotatably in the casing, the drum brush having a plurality of bristles on an external surface arranged to shake off dust from the surface being cleaned; and a rib which is disposed at a position close to the drum brush and is mounted in the casing so that one end is in contact with the plurality of bristles, and the rib is configured to detach the dust from the plurality of bristles when the drum brush rotates, and wherein the plurality of bristles are arranged on the drum brush at an angle of inclination relative to a radial direction, and the bristles enter the rib with an obtuse angle so as to receive friction power from the rib, and the friction power prevents the drum brush from rotating when the suction port assembly is pulled towards a user.

6. The vacuum cleaner of claim 5, wherein the rib is disposed to fill a space between the casing and the drum brush in order that noise flowing back from the cleaner main body to the rib is not emitted to an exterior of the suction port assembly.

* * * * *